US009592585B2

(12) United States Patent
Lin et al.

(10) Patent No.: US 9,592,585 B2
(45) Date of Patent: Mar. 14, 2017

(54) SYSTEM AND METHOD FOR CMP STATION CLEANLINESS

(71) Applicant: Taiwan Semiconductor Manufacturing Company, Ltd., Hsin-Chu (TW)

(72) Inventors: Kuo-Yin Lin, Jhubei (TW); Teng-Chun Tsai, Tainan (TW); Wan-Chun Pan, Hsinchu (TW); Hsiang-Pi Chang, New Taipei (TW); Chi-Yuan Chang, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 878 days.

(21) Appl. No.: 13/730,146

(22) Filed: Dec. 28, 2012

(65) Prior Publication Data

US 2014/0182633 A1 Jul. 3, 2014

(51) Int. Cl.

| | |
|---|---|
| ***B24B 37/04*** | (2012.01) |
| ***B24B 55/00*** | (2006.01) |
| ***B24B 53/017*** | (2012.01) |
| ***B08B 3/02*** | (2006.01) |

(52) U.S. Cl.

CPC ..... *B24B 55/00* (2013.01); *B08B 3/02* (2013.01); *B24B 53/017* (2013.01)

(58) Field of Classification Search

None

See application file for complete search history.

(56) References Cited

U.S. PATENT DOCUMENTS

| | | | | |
|---|---|---|---|---|
| 5,738,574 | A * | 4/1998 | Tolles | B08B 1/007 257/E21.23 |
| 6,206,760 | B1 * | 3/2001 | Chang | B24B 37/04 451/41 |
| 6,283,840 | B1 | 9/2001 | Huey | |
| 6,527,624 | B1 | 3/2003 | Tolles et al. | |
| 6,672,950 | B2 * | 1/2004 | Peng | B24B 37/34 451/444 |
| 7,004,814 | B2 | 2/2006 | Chen et al. | |
| 7,118,451 | B2 | 10/2006 | Chen et al. | |
| 2003/0051743 | A1 * | 3/2003 | Breese | B08B 3/12 134/33 |

(Continued)

FOREIGN PATENT DOCUMENTS

| | | |
|---|---|---|
| CN | 1661780 | 8/2005 |
| TW | 393378 | 6/2000 |

(Continued)

*Primary Examiner* — Douglas Lee
*Assistant Examiner* — Ryan Coleman
(74) *Attorney, Agent, or Firm* — Slater Matsil, LLP

(57) ABSTRACT

System and method for CMP station cleanliness. An embodiment comprises a chemical mechanical polishing (CMP) station comprising a housing unit covering the various components of the CMP station. The CMP station further comprising various surfaces of a slurry arm shield, a slurry spray nozzle, a pad conditioning arm shield, a platen shield, a carrier head; and the interior, vertical surfaces of the housing unit. A cleaning liquid delivery system configured to dose a cleaning liquid on the various surfaces of the CMP station at set intervals.

12 Claims, 6 Drawing Sheets

(56) References Cited

U.S. PATENT DOCUMENTS

2009/0264049 A1* 10/2009 Chen ..... B08B 15/04
451/28

FOREIGN PATENT DOCUMENTS

| | | |
|---|---|---|
| TW | 492906 | 7/2002 |
| TW | 513336 | 12/2002 |
| TW | 573584 | 1/2004 |
| TW | 200529312 | 9/2005 |
| TW | 200532789 | 10/2005 |
| TW | 200641964 | 12/2006 |
| WO | 9951398 | 10/1999 |

* cited by examiner

600

SYSTEM AND METHOD FOR CMP STATION CLEANLINESS

BACKGROUND

Generally, chemical mechanical polishing (CMP) may be used during the semiconductor device manufacturing process to planarize various aspects of a device as it is made. For example, the formation of various features or layers in a device may cause uneven topography, and this uneven topography may interfere with subsequent manufacturing processes, such as the photolithographic process. It is, therefore, desirable to planarize the surface of the device, using known methods such as CMP, after various features or layers are formed.

Typically, CMP involves placing a device wafer in a carrier head. The carrier head and the wafer are then rotated as downward pressure is applied to the wafer against a polishing pad. A chemical solution, referred to as a slurry, is deposited onto the surface of the polishing pad and under the wafer to aid in the planarizing. Thus, the surface of a wafer may be planarized using a combination of mechanical (the grinding) and chemical (the slurry) forces.

However, the physical act of grinding a wafer against the slurry may cause excess slurry to spray up onto the various mechanical parts, windows, or walls of a typical CMP station. Over time, this excess slurry may accumulate and dry into a caked-on residue on the surfaces of the CMP station. This residue may cause various problems if left unattended. For example, residue left a mechanical arm of the CMP station, such as a slurry arm, could fall onto the polishing pad during a subsequent CMP process and cause wafer scratches. Furthermore, due to the nature of the slurry's interaction with the materials in a wafer, the residue may be toxic in nature and pose serious health risks.

It is therefore desirable to periodically clean the surfaces of a CMP station. Traditionally, this cleaning has been done manually. Typically, the CMP station is shut down, and workers manually scrub the various surfaces of the station clean. These maintenance downtimes create inefficiencies and delays in the manufacturing process. Furthermore, the residue itself may be toxic and creates a hazardous work environment for the workers. A new system and method for a self-cleaning CMP station is provided to address these concerns.

BRIEF DESCRIPTION OF THE DRAWINGS

For a more complete understanding of the present embodiments, and the advantages thereof, reference is now made to the following descriptions taken in conjunction with the accompanying drawings, in which.

DETAILED DESCRIPTION OF ILLUSTRATIVE EMBODIMENTS

The making and using of the present embodiments are discussed in detail below. It should be appreciated, however, that the present disclosure provides many applicable inventive concepts that can be embodied in a wide variety of specific contexts. The specific embodiments discussed are merely illustrative of specific ways to make and use the disclosed subject matter, and do not limit the scope of the different embodiments.

Figure 1:
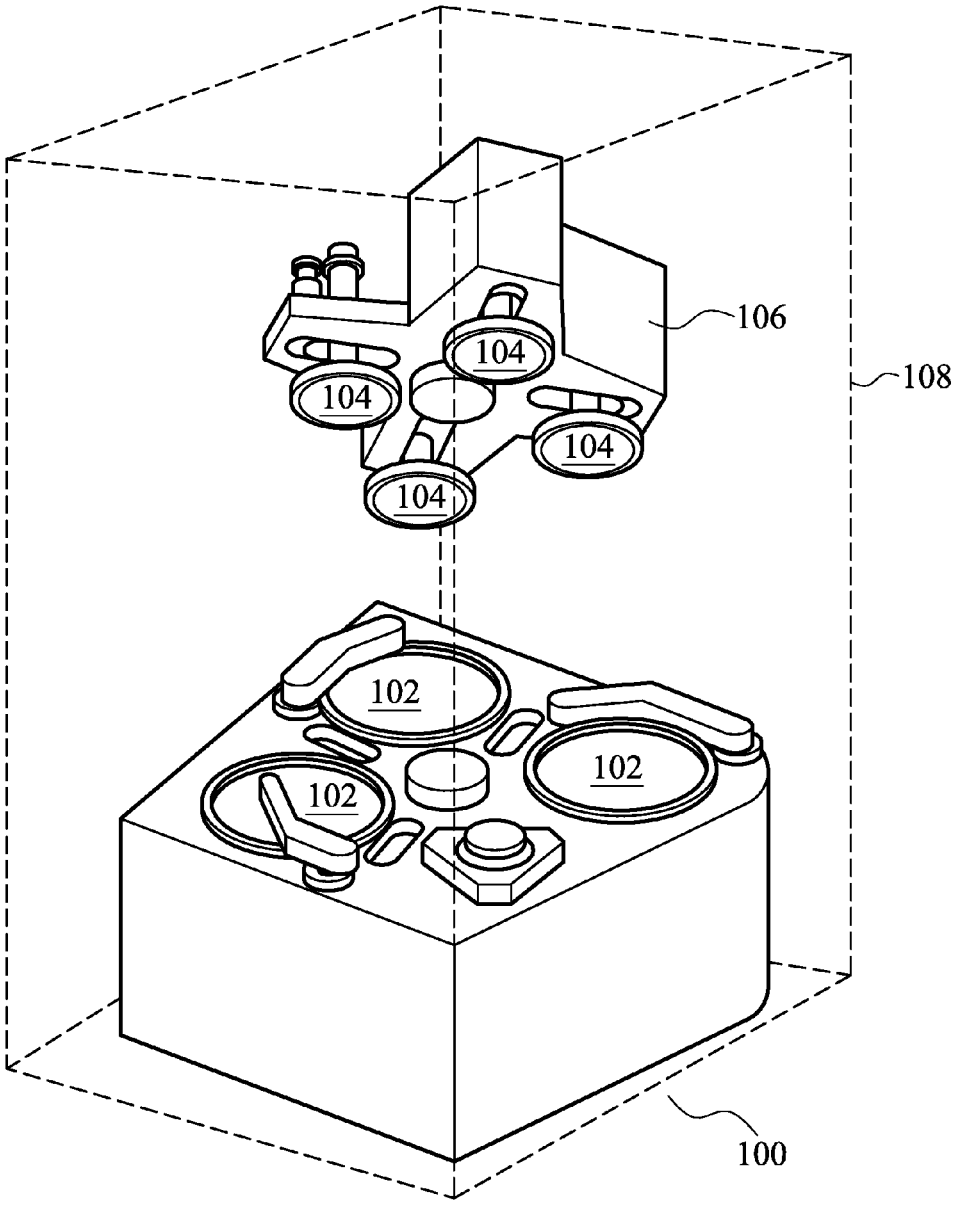
FIG. 1 shows a prospective view of a portion of a multiple pad CMP station as is known in the art.

With reference now to FIG. 1, an exemplary multiple-pad chemical mechanical polishing (CMP) station as is known in the art is shown, for example the MIRRA™ system available from Applied Materials, Inc. of Santa Clara, Calif. However, various embodiments may be applied to other CMP equipment from other manufacturers or to other planarization systems as well. CMP station 100 comprises multiple polishing pads 102 and a carousel 106. Carousel 106 supports a multitude of carriers 104, which may hold several wafers (not shown) for polishing simultaneously. In an embodiment, CMP station 100 is housed in an enclosed area, such as enclosure 108. Enclosure 108 serves to limit outside contaminates from interfering with the CMP process as well as limit the number surfaces that could be exposed to splatter residue from the CMP process. While FIG. 1 shows a CMP station comprising four carriers 104 and three polishing pads 102, it is contemplated in other embodiments to have a CMP station comprising a different number of carrier heads and polishing pads. It is also contemplated in other embodiments for CMP station 100 to be a single-pad CMP station.

Figure 2:
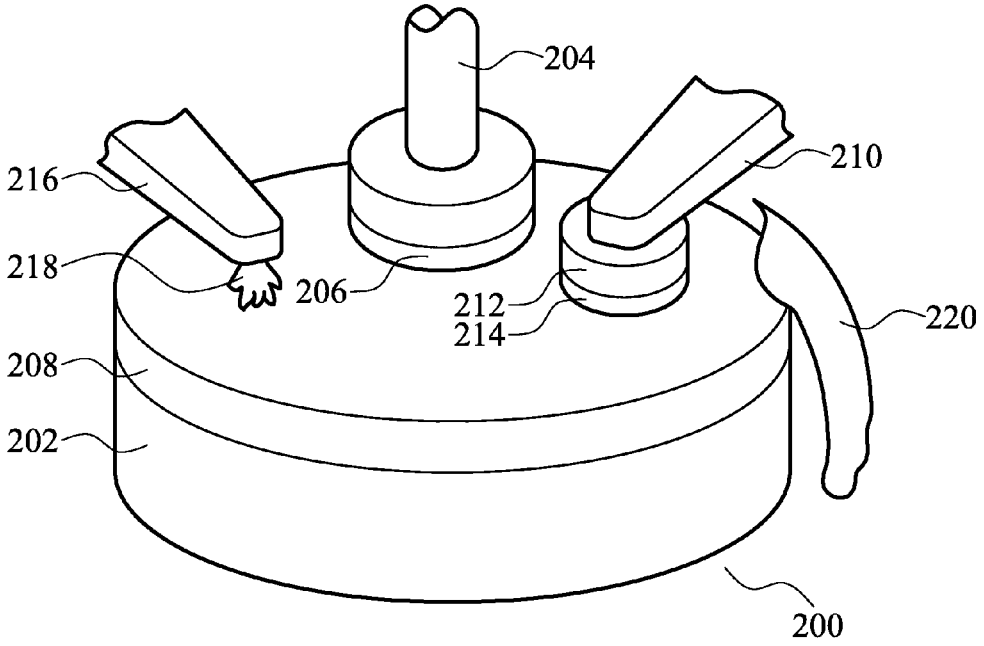
FIG. 2 shows a prospective view of a portion of a typical CMP polishing pad as is known in the art.

FIG. 2 shows a perspective view of a polishing station 200, which may be a portion of multiple-pad CMP station 100 of FIG. 1. Polishing station 200 includes a rotating platen 202 over which a polishing pad 208 has been placed. Polishing pad 208 may correspond to a particular polishing pad 102 shown in FIG. 1. A platen shield 220 (only a portion is shown for illustration's sake) typically encircles the majority of platen 202, and platen shield 220 protects the polishing pad from outside contamination and helps to contain splatter residue created by the CMP process.

A rotating carrier 204, which may correspond to a particular carrier 104 in FIG. 1, is placed over polishing pad 208. Rotating carrier 204 includes retaining ring 206. A wafer (not shown) may be placed within carrier 204 and is held by in place by retaining ring 206 during CMP. The wafer is positioned so that the surface to be planarized faces downward towards polishing pad 208. Carrier 204 applies downward pressure and causes the wafer to come in contact with polishing pad 208.

A pad conditioner arm 210 moves a rotating pad conditioning head 212 in a sweeping motion across a portion of the polishing pad 208. Conditioning head 212 holds a pad conditioner 214 in contact with polishing pad 104. Pad conditioner 214 typically comprises a substrate over which an array of abrasive particles, such as diamonds, is bonded using, for example, electroplating. Pad conditioner 214 removes built-up wafer debris and excess slurry from polishing pad 208. Pad conditioner 214 also acts as an abrasive for polishing pad 208 to create an appropriate texture against which the wafer may be properly planarized.

A slurry arm 216 deposits a slurry 218 onto polishing pad 208. The rotating movement of platen 202 causes slurry 218 to be distributed over the wafer. The wafer is then polished due to a combination of the physical grinding of carrier 204 against polishing pad 214 and the chemical interactions between the wafer material and slurry 218. At the same time, the combination of the rotating carrier 204 and the rotating platen 202 may cause slurry to spray onto the various exposed surfaces of the CMP station. These exposed surfaces may comprise the surfaces of slurry arm 216, the slurry nozzle (not shown), pad conditioner arm 210, carrier 204, and platen shield 220. The exposed areas may further comprise the surfaces of carousel 104 and the interior walls and windows of Enclosure 108 in FIG. 1. If left unattended, the splattered slurry may build up over time into a residue that may cause various issues such as wafer scratch.

The composition of slurry 218 depends on the type of material on the wafer surface undergoing CMP. For example, the CMP process for indium phosphide (InP) may use a slurry comprising hydrochloric acid (HCl). Unfortunately, the interaction between the material on the wafer and slurry 218 may produce a toxic byproduct. In the InP CMP example given, the interaction between InP and HCl may produce phosphine ($PH_3$), flammable toxic gas, as a byproduct. In other CMP processes, other toxic byproducts may be produced. The presence of toxic byproducts creates a hazardous work environment for any workers entering the CMP station to clean the various surfaces of splatter residue.

In an embodiment of the present invention, a self-cleaning CMP station is disclosed. A CMP station would be outfitted with a cleaning solution delivery system comprising a series of pipes. The series of pipes deliver cleaning liquid for keeping the various surfaces of the CMP station clean without the need for workers to manually scrub the various surfaces of the CMP station. The series of pipes may comprise a drip manifold dripping cleaning solution at regular intervals over the surfaces in the CMP station. It is also contemplated for the pipes to comprise spray nozzles to spray cleaning solution at regular intervals over a CMP component's surface.

In an embodiment, the cleaning solution would be deionized water (DIW). DIW is chemically neutral and would not interfere with the CMP process. Prevention of slurry residue build-up is avoided by regularly rinsing the various surfaces of a CMP station. This rinsed off residue would be disposed of through a drainage system present in a typical CMP station. For example, in FIG. 1, the drainage system (not shown) would be located in the center of the floor of enclosure 108. The floors of enclosed region 108 would be slightly sloped downwards towards the center to facilitate drainage.

In an alternative embodiment, the cleaning solution may comprise either an acid or an alkali. The acidic or alkaline solution would be very diluted so as not to damage any components of the CMP station or interfere adversely with the CMP process. For example, it is contemplated to use a solution with a concentration level of only 0.1% to 10%. The advantage of using an acid or alkali solution is to prevent the formation of any toxic byproducts that would have otherwise been created during a particular CMP process. For example, the introduction of a diluted hydrogen peroxide ($H_2O_2$) solution during InP CMP may stop the formation of the toxic byproduct, $PH_3$. The InP, HCl, and $H_2O_2$ react together to create soluble hydrogen ions, $H^+$, and phosphate ions, $PO_4^+$, instead of $PH_3$. Therefore, by spraying a diluted chemical solution in the CMP station, either prior to or during CMP, toxic byproducts may be avoided.

Figure 3:
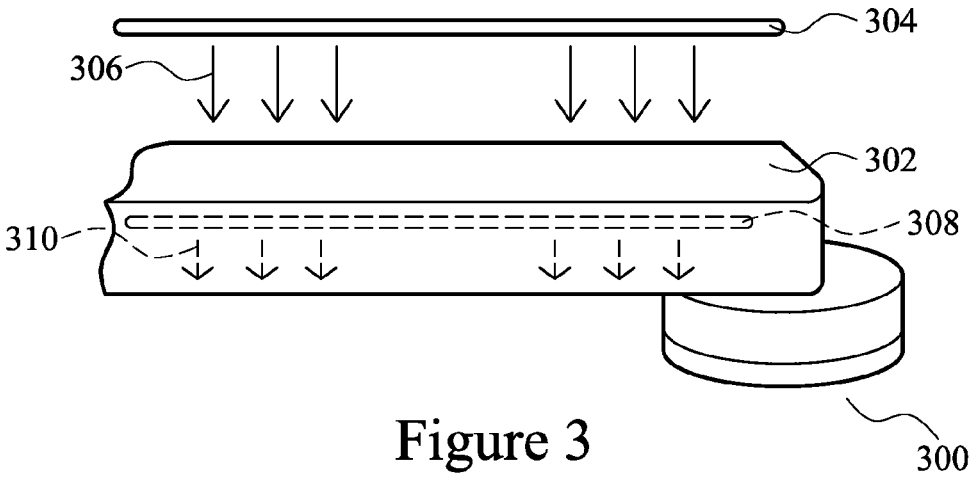
FIG. 3 shows a CMP pad conditioning arm according to an embodiment.

Now referring to FIG. 3, a portion of the cleaning solution delivery system involving the pad conditioner arm is shown according to an embodiment. Pad conditioning apparatus 300 corresponds to the pad conditioner arm 210, pad conditioner head 212, and conditioner pad 214 of FIG. 2. The pad conditioner arm of apparatus 300 may comprise an arm cover 302. In an embodiment, cover 302 may comprise a pitched surface top surface to facilitate drainage. For example, in FIG. 3, the top surface of cover 302 is shaped like a triangular prism. It is contemplated in other embodiments, for the pitched top surface to be configured in a different shape or for cover 302 to not comprise a pitched top surface.

A cleaning fluid delivery pipe 304 is placed over the position of pad conditioning apparatus 300 when apparatus 300 is in an idle state (i.e., when the pad conditioner is not actively sweeping across the polishing pad). Pipe 304 rinses cover 302 with the cleaning solution as indicated by arrows 306. A separate cleaning fluid delivery pipe 308 is shown in ghost in FIG. 3. Pipe 308 may be placed on the interior of cover 302 and rinse the interior of cover 302 with cleaning fluid as indicated by arrows 310. Pipes 304 and 308 may rinse cover 302 at regular intervals, for example, continuously whenever apparatus 300 is idle.

Figure 4:
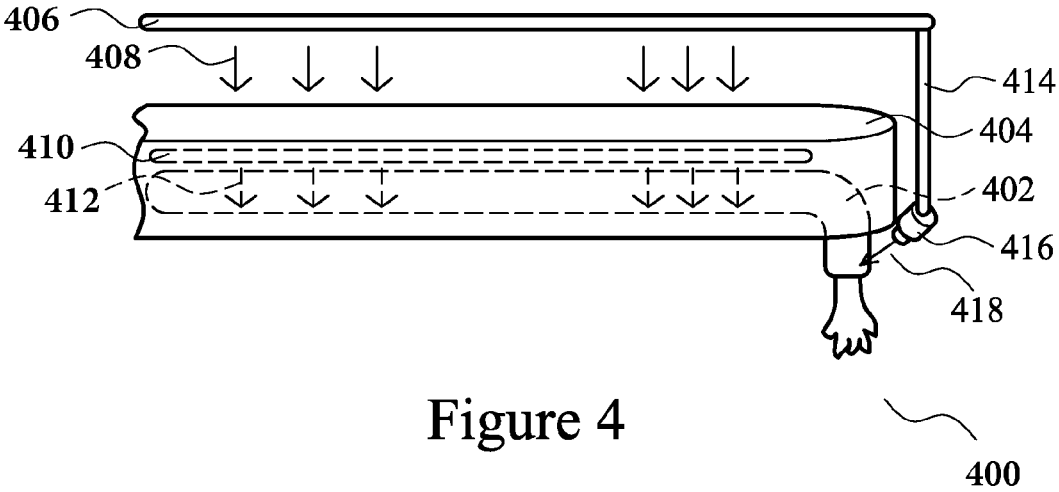
FIG. 4 shows a CMP slurry arm according to an embodiment.

FIG. 4 shows a portion of the cleaning solution deliver system involving the slurry arm according to an embodiment. Slurry arm 400 corresponds with slurry arm 216 in FIG. 2. Slurry arm 400 comprises a slurry arm cover 404 and a slurry delivery pipe 402. The portion of slurry delivery pipe 402 enclosed in cover 404 is shown in ghost, while the nozzle portion of pipe 402 may be exposed. Cleaning fluid delivery pipe 406 rinses slurry arm cover 404 with a cleaning fluid, as indicated by arrows 408. A separate cleaning fluid delivery pipe 410, shown in ghost, may be placed on the interior of cover 404 to rinse the interior surface of cover 404 with a cleaning fluid. Arrows 412 indicate this rinsing. In an embodiment, the slurry nozzle of pipe 402 may be sprayed with cleaning fluid via spray nozzle 416, as indicated by arrow 418. Spray nozzle 416 may receive cleaning fluid from a pipe 414. The slurry arm cover 404 and slurry nozzle may be rinsed at regular intervals, for example, when the CMP station is in an idle mode and not actively polishing a wafer.

Figure 5:
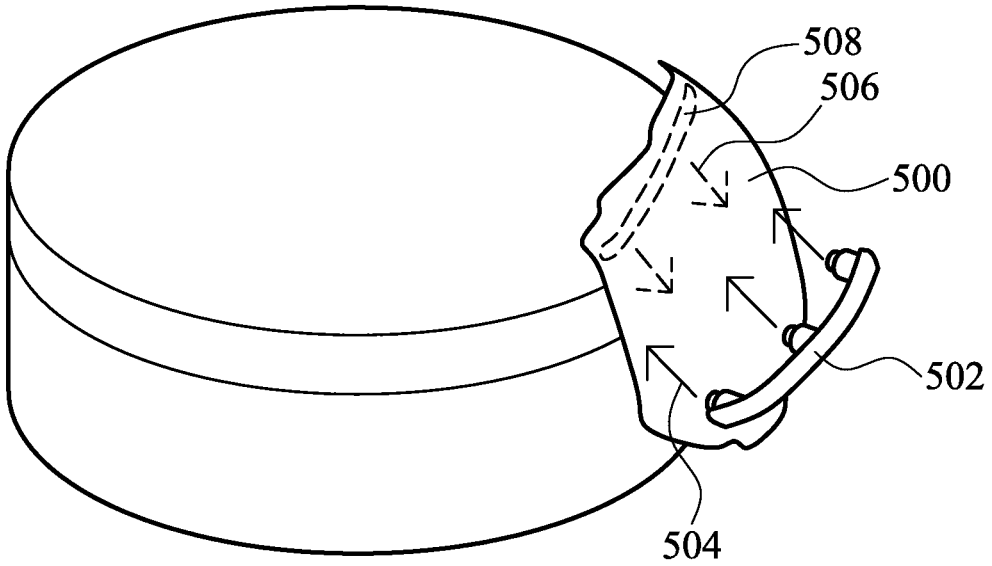
FIG. 5 shows a CMP platen according to an embodiment.

FIG. 5 shows a portion of the cleaning solution delivery system involving the platen shield according to an embodiment. Platen shield 500 corresponds with platen shield 220 in FIG. 2. Cleaning fluid delivery pipes 502 and 508 (shown in ghost) rinse the exterior and interior of platen shield 220 with a cleaning fluid, as indicated by arrows 504 and 506 respectively. Only a portion of platen shield 500 and pipes 502 and 508 are shown for illustration sake. In an embodiment, platen shield 500 encompasses the majority of the platen, and pipes 502 and 508 clean the entirety of platen shield 500. Pipes 502 and 508 rinse platen shield 500 at regular intervals, for example whenever the CMP station is in idle mode.

Figure 6:
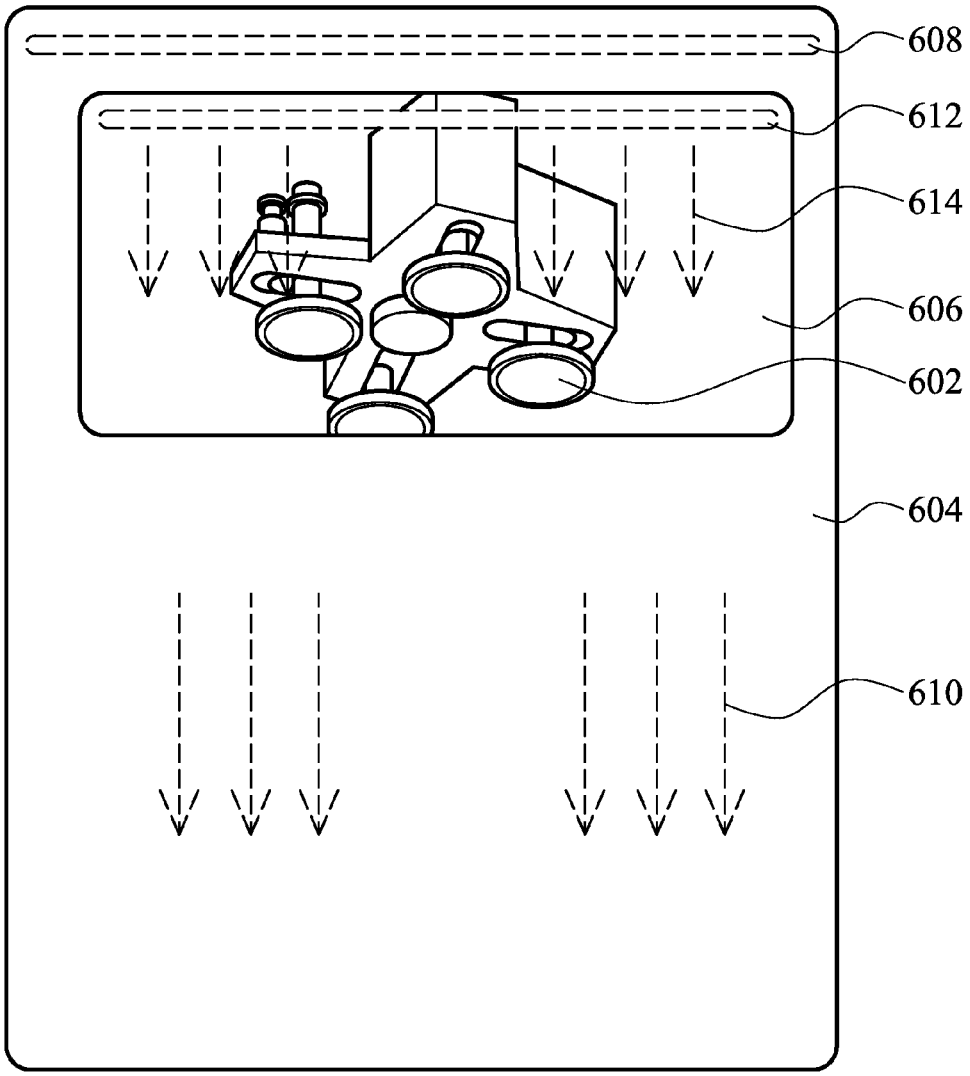
FIG. 6 shows a CMP housing enclosure according to an embodiment.

FIG. 6 shows a portion of the cleaning solution delivery system involving the CMP station enclosure according to an embodiment. Enclosure 600 corresponds to enclosure 100 in FIG. 1. As shown in FIG. 6, a CMP station 602 is placed within enclosure 600. Enclosure 600 may comprise multiple walls 604 and windows 606. For illustration sake, only one wall 604 and window 606 is shown. Various pipes 608 and 612 (shown in ghost) clean the interior of wall 604 and window 602 respectively at regular intervals or continuously. Pipes 608 and 612 rinse clean the interiors of wall 604 and window 606 with a cleaning fluid, as indicated by arrows 610 and 614 respectively.

Figure 7:
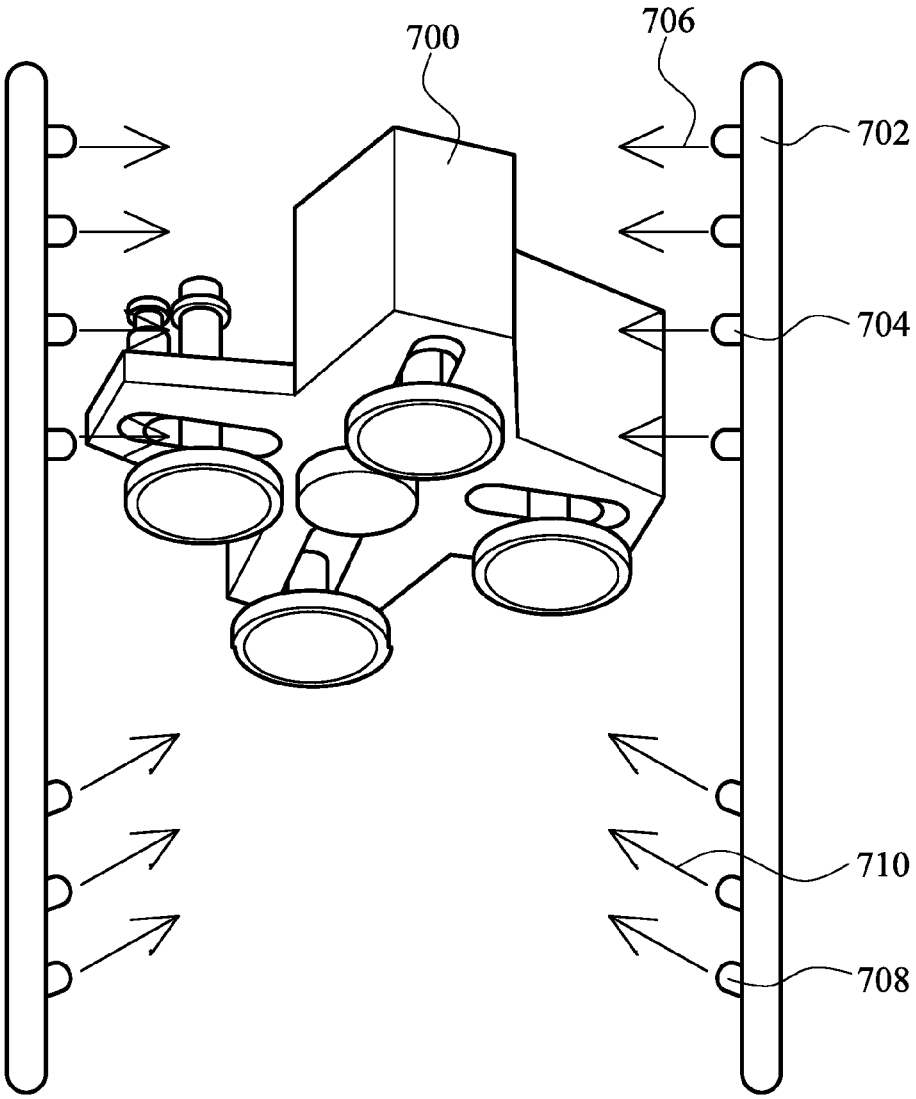
FIG. 7 shows a CMP carrier carousel according to an embodiment.

FIG. 7 shows a portion of the cleaning solution delivery system involving the carrier carousel according to an embodiment. Carrier carousel 700 corresponds with carousel 106 in FIG. 1. Shower tower 702 rinses carousel 700 with a cleaning fluid. While two shower towers 702 are shown in FIG. 7, it is contemplated in other embodiments to have a different number of shower towers. Shower tower 702 comprises nozzles 704 and 708. As shown by arrows 706, nozzles 704 spray cleaning fluid in a primarily horizontal direction to clean the vertical surfaces of carousel 106. Similarly, nozzles 708 spray cleaning fluid at an upward angle to clean the bottom surfaces of carousel 106, as shown by arrows 710. In an embodiment, nozzles 704 and 708 spray cleaning liquid at regular intervals, for example when carousel 700 is in idle mode. Carousel 700 is in idle mode whenever it is neither actively polishing a wafer nor actively changing out wafers to be polished. It is contemplated in an alternate embodiment to clean a carrier directly, for example in a single-pad CMP station.

Although the present embodiments and their advantages have been described in detail, it should be understood that various changes, substitutions and alterations can be made herein without departing from the spirit and scope of the disclosure as defined by the appended claims. For example, a number of specific pipes and nozzles have been disclosed in the present embodiments. It is contemplated in various embodiments to have a CMP self-cleaning system with a different configuration of or a different number of pipes and/or nozzles.

Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A chemical mechanical polishing (CMP) station comprising:

a housing unit enclosing components of the CMP station;

surfaces within the housing unit comprising:

surfaces of a slurry arm cover of a slurry arm;

exterior surfaces of a slurry spray nozzle;

surfaces of a pad conditioning arm shield;

surfaces of a platen shield;

exterior surfaces of a carrier head; and interior, vertical surfaces of the housing unit; and a cleaning liquid dosing system configured to dose cleaning liquid on the surfaces of the CMP station at set intervals, the cleaning liquid dosing system comprising;

a first cleaning fluid delivery pipe positioned along a longitudinal length of a slurry arm, above the slurry arm cover of the slurry arm;

a second cleaning fluid delivery pipe positioned along the longitudinal length of the slurry arm, between the slurry arm cover and a slurry delivery pipe of the slurry arm;

wherein the first and second cleaning fluid delivery pipes are configured to dose the cleaning liquid via openings in sidewalls of the cleaning fluid delivery pipes.

2. The CMP station according to claim 1, wherein the cleaning liquid dosing system is configured to dose the surfaces of the slurry arm cover, the exterior surfaces of the slurry spray nozzle, the surfaces of the pad conditioning arm shield, and the surfaces of the platen shield only when the CMP station is not actively polishing a wafer.

3. The CMP station according to claim 1, wherein the cleaning liquid dosing system is configured to dose the exterior surfaces of the carrier head only when the carrier head is in idle mode.

4. The CMP station according to claim 1 wherein the cleaning liquid is a liquid selected from the group consisting essentially of deionized water, an acidic solution, an alkali solution, and combinations thereof.

5. The CMP station of claim 1, wherein the cleaning liquid dosing system further comprises:

a third cleaning fluid delivery pipe positioned along a length of a pad conditioning arm, above the pad conditioning arm shield;

a fourth cleaning fluid delivery pipe positioned along a length of the pad conditioning arm and beneath the pad conditioning arm shield;

a fifth cleaning fluid delivery pipe positioned along an outside surface of the platen shield, the fifth cleaning pipe having nozzles along its length, the nozzles pointing toward the outside surface of the platen shield; and a sixth cleaning fluid delivery pipe positioned along an inside surface of the platen shield, the sixth cleaning pipe having nozzles along its length, the nozzles pointing toward the inside surface of the platen shield, wherein the third, fourth, fifth, and sixth cleaning fluid delivery pipes are configured to dose the cleaning liquid via openings in sidewalls of the cleaning fluid delivery pipes.

6. A self-cleaning chemical mechanical polishing (CMP) station comprising:

a polishing station, the polishing station comprising:

a platen;

a polishing pad on the platen;

a platen shield encircling at least a portion of the platen; and a pad conditioning apparatus comprising a pad conditioner arm attached to a pad conditioning head, the pad conditioning head configured to hold a pad conditioner in contact with the polishing pad, the pad conditioner arm comprising a cover, wherein a top surface of the cover is pitched;

a first cleaning fluid delivery pipe over the pad conditioning apparatus, the first cleaning fluid delivery pipe configured to deliver a cleaning solution to an upper surface of the cover of the pad conditioner arm;

a slurry arm configured to deposit a slurry on the polishing pad, the slurry arm comprising a cover and a slurry delivery pipe;

a second cleaning fluid delivery pipe over the slurry arm, the second cleaning fluid delivery pipe configured to deliver a cleaning solution to an upper surface of the cover of the slurry arm;

a carousel, the carousel comprising at least one carrier, the at least one carrier comprising a retaining ring;

at least one shower tower configured to deliver a cleaning solution to surfaces of the carousel;

an enclosure surrounding the polishing station and the carousel, the enclosure comprising at least one wall and at least one window;

a third cleaning fluid delivery pipe under the pad conditioner arm cover of the pad conditioner arm;

a fourth cleaning fluid delivery pipe over the slurry delivery pipe and under the cover of the slurry arm, the fourth cleaning fluid delivery pipe configured to deliver a cleaning solution to a surface of the slurry delivery pipe; and a plurality of pipes configured to deposit a cleaning solution onto interior surfaces of the enclosure.

7. The CMP station according to claim 6, wherein the plurality of pipes comprises a drip manifold.

8. The CMP station according to claim 6, wherein the cleaning solution comprises an acid or an alkali.

9. The CMP station according to claim 6, wherein the top surface comprises a triangular prism shape.

10. The CMP station according to claim 6, further comprising: a fifth cleaning fluid delivery pipe attached to the second cleaning fluid delivery pipe; and a spray nozzle attached to the fifth cleaning fluid delivery pipe, the spray nozzle configured to spray a cleaning solution onto a slurry nozzle of the slurry delivery pipe.

11. The CMP station according to claim 6, further comprising a plurality of cleaning fluid delivery pipes configured to spray a cleaning solution on an interior surface and an exterior surface of the platen shield.

12. The CMP station according to claim 6, wherein the at least one shower tower comprises at least one first nozzle and at least one second nozzle, the at least one first nozzle configured to deliver the cleaning solution to vertical surfaces of the carousel, and the at least one second nozzle configured to deliver the cleaning solution to bottom surfaces of the carousel.

* * * * *